US006238241B1

(12) United States Patent
Zhu et al.

(10) Patent No.: US 6,238,241 B1
(45) Date of Patent: May 29, 2001

(54) STACKED ELECTRICAL CONNECTOR ASSEMBLY

(75) Inventors: ZiQiang Zhu; ZhongHua Yao, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,737

(22) Filed: Dec. 27, 1999

(51) Int. Cl.[7] ..... H01R 12/20
(52) U.S. Cl. ..... 439/541.5; 439/79; 439/607
(58) Field of Search ..... 439/541.5, 79, 439/701, 607, 609

(56) References Cited

U.S. PATENT DOCUMENTS

| | | | | |
|---|---|---|---|---|
| 4,612,602 | * | 9/1986 | Weyer et al. | 439/541.5 |
| 5,037,330 | * | 8/1991 | Fulponi et al. | 439/541.5 |
| 5,336,109 | * | 8/1994 | Hillbish et al. | 439/541.5 |
| 5,417,585 | * | 5/1995 | Morin et al. | 439/541.5 |
| 5,637,015 | * | 6/1997 | Tan et al. | 439/607 |
| 5,709,554 | * | 1/1998 | Savage, Jr. | 439/541.5 |
| 5,797,770 | * | 8/1998 | Davis et al. | 439/541.5 |

* cited by examiner

*Primary Examiner*—Gary F. Paumen
(74) *Attorney, Agent, or Firm*—Wei Te Chung

(57) ABSTRACT

An electrical connector assembly of the present invention comprises an upper connector, a lower connector, a spacer, and a rear shield. The upper electrical connector comprises an insulative housing comprising a groove in a bottom surface thereof, a pair of shielding shells partially enclosing the housing, a plurality of electrical contacts accommodated in the insulative housing, and a front shield shielding the front and the top of the insulative housing. The front shield further defines a mounting hole in an upper section thereof for mounting the electrical connector assembly to an enclosure panel. The lower connector comprises a dielectric housing comprising a rib on a top surface thereof corresponding to the groove of the upper connector, a pair of inner shields partially enclosing the dielectric housing, and a plurality of electrical contacts mounted in the dielectric housing. Each of the electrical contacts of the upper and the lower electrical connectors comprises a soldering portion extending beyond the respective housings. The spacer forms a plurality of through holes for receiving soldering portions of corresponding electrical contacts of the upper and the lower electrical connectors and an intermediate portion engaging with the dielectric housing of the lower electrical connector. The rear shield encloses the spacer and rear portions of the upper and the lower electrical connectors.

1 Claim, 5 Drawing Sheets

STACKED ELECTRICAL CONNECTOR ASSEMBLY

BACKGROUND OF THE INVENTION

1. Field of the Invention

The present invention relates to a stacked electrical connector assembly, and particularly to an electrical connector assembly formed by stacking two different type electrical connectors.

2. Description of the Prior Art

Stacked electrical connectors have been used to save the valuable estate of the printed circuit board on which the connectors are mounted. U.S. Pat. Nos. 5,637,015 issued on Jun. 10, 1997, No. 5,037,330 issued on Aug. 6, 1991, and No. 5,797,770 issued on Aug. 25, 1998, and so on, disclose such electrical connector assemblies by stacking connectors of the same type. With the development of electronic technology, electrical connector assemblies by stacking connectors of different types are desired to further save the precious space of the printed circuit board, improve integrity of electrical components, promote reliability of signal transmission, and keep pace with the development of related arts.

SUMMARY OF THE INVENTION

A first object of the present invention is to provide an electrical connector assembly by stacking two different types of connectors, which is easy to assemble and reduces production cost; and A second object of the present invention is to provide a stacked electrical connector assembly having a spacer to securely retain electrical contacts thereof.

An electrical connector assembly in accordance with the present invention comprises an upper electrical connector, a lower electrical connector, an insulative spacer, and a rear shield.

The upper electrical connector comprises an insulative housing, a pair of frame-shaped shielding shells, a plurality of electrical contacts, and a front shield. The housing comprises a pair of chambers, one upper one lower, a pair of receiving plates each extending in respective chambers and a groove in a bottom face thereof. The electrical contacts of the upper electrical connector are arranged in two rows and each comprises an engaging portion and a soldering portion. The engaging portions of each row of the upper electrical contacts are received in one corresponding receiving plate and are shielded by one shielding shell partially enclosing the insulative housing. The front shield comprises a vertical portion, a transverse portion extending perpendicularly from a top of the vertical portion, and a mounting plate extending upward from the top of the vertical portion. The vertical portion engages with the shielding shells to retain each other. The mounting plate defines a mounting hole near an upper end thereof. The transverse portion forms a latch at a rear end thereof.

The lower electrical connector comprises a dielectric housing, a pair of frame-shaped inner shields, and a plurality of electrical contacts arranged in four rows. The dielectric housing comprises a pair of chambers, one upper one lower, a pair of accommodating plates extending in respective chambers, and a rib at a top surface thereof for engaging with the groove of the upper connector. Each contact of the lower connector comprises an engaging portion and a soldering portion. Each accommodating plate accommodates the engaging portions of two rows of the contacts of the lower connector in an upper and lower surface thereof. The inner shields partially enclose the dielectric housing of the lower connector and shield the engaging portions of the contacts of the lower connector.

The spacer is mounted onto the dielectric housing of the lower connector and comprises a stepped front side defining through holes therein for receiving the soldering portions of the contacts of the lower connector and a stepped rear side for receiving the soldering portions of the contacts of the upper connector.

The rear shield encloses the spacer and rear portions of the upper and the lower connectors.

Other objects, advantages and novel features of the invention will become more apparent from the following detailed description of the present embodiment when taken in conjunction with the accompanying drawings.

DETAILED DESCRIPTION OF THE INVENTION

Figure 1:
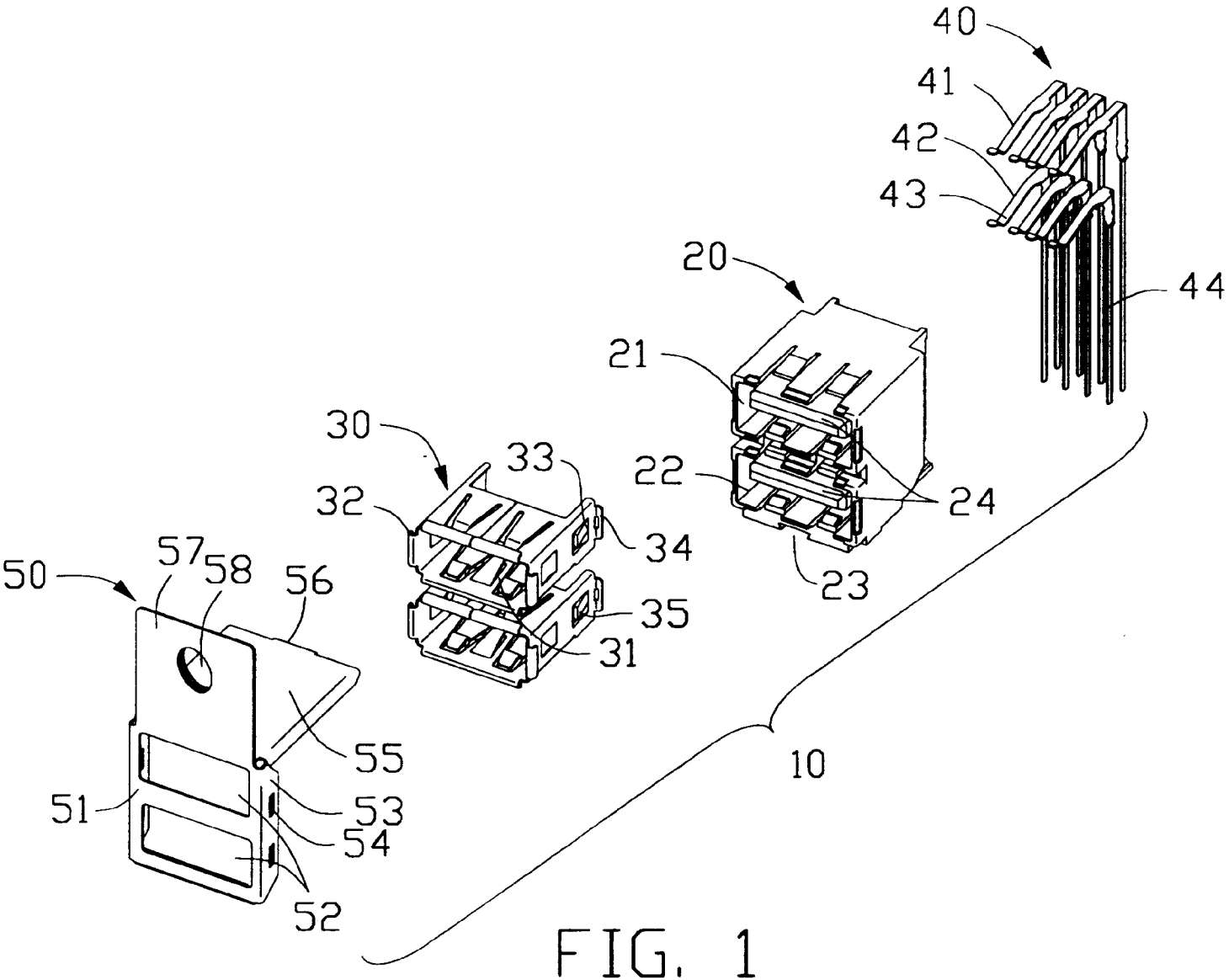
FIG. 1 is an exploded view of an upper connector of an electrical connector assembly in accordance with the present invention.
Figure 2:
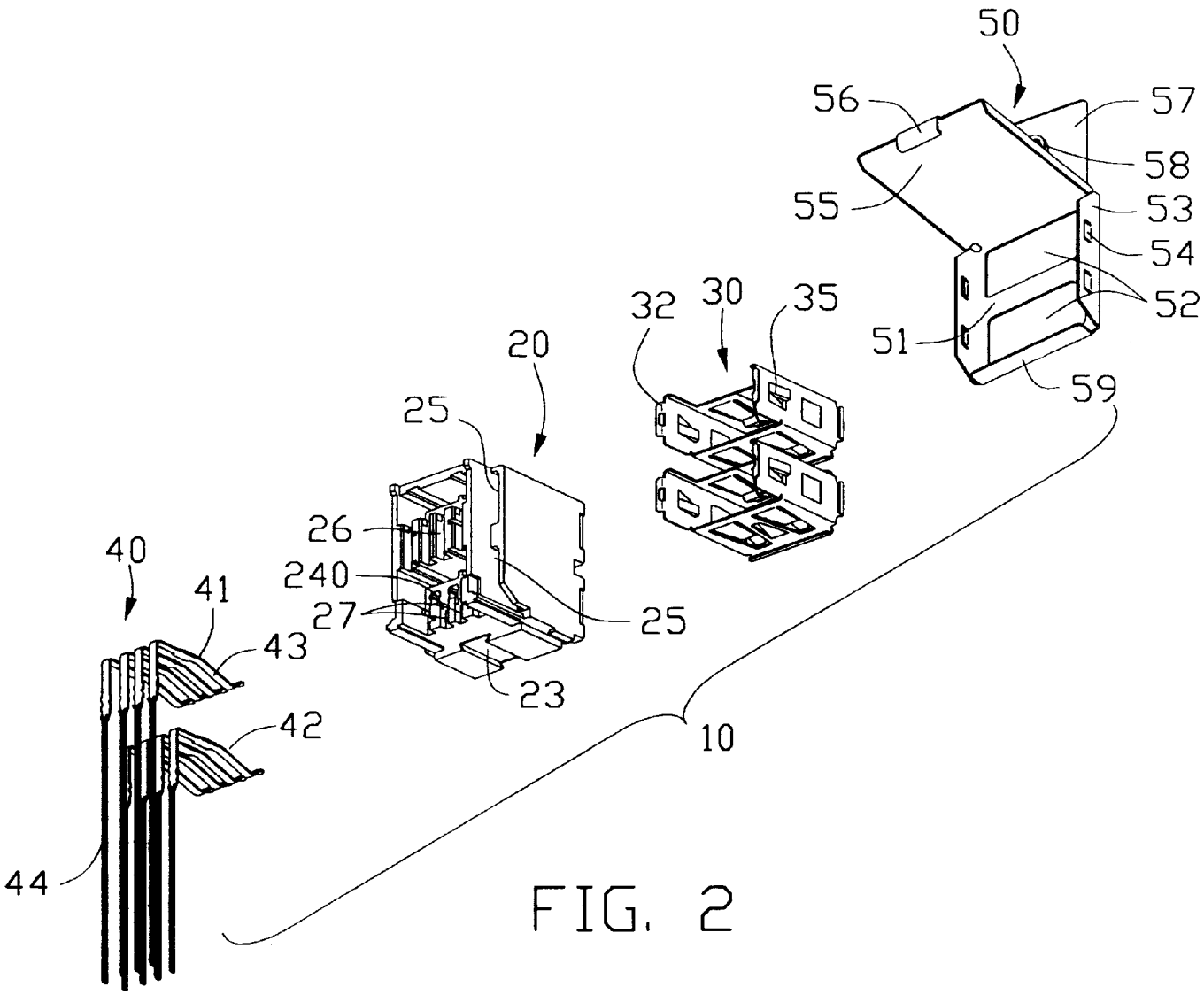
FIG. 2 is similar to FIG. 1 but taken from a different perspective.
Figure 3:
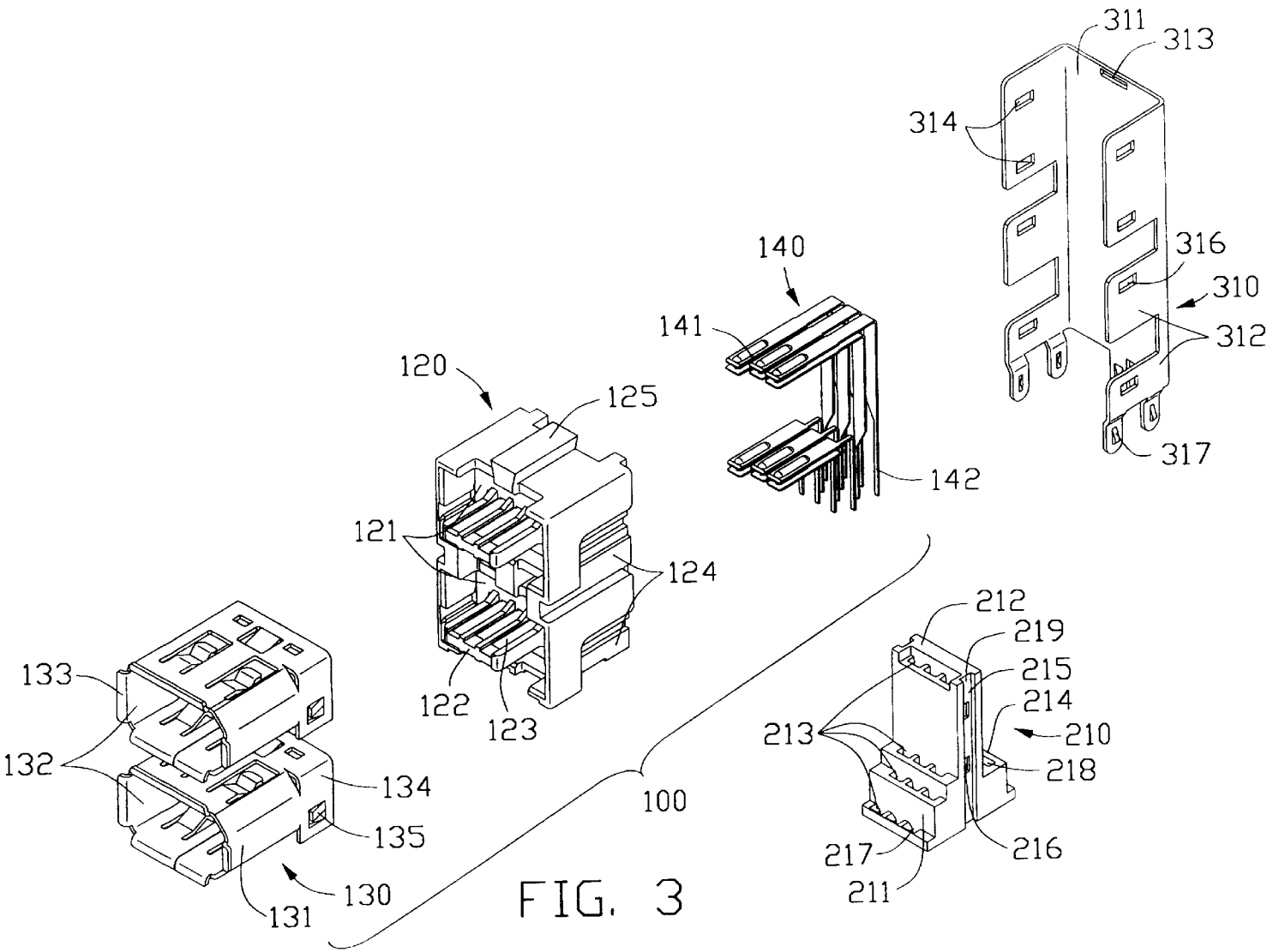
FIG. 3 is an exploded view of a lower connector, a spacer, and a rear shield of the electrical connector assembly in accordance with the present invention.
Figure 4:
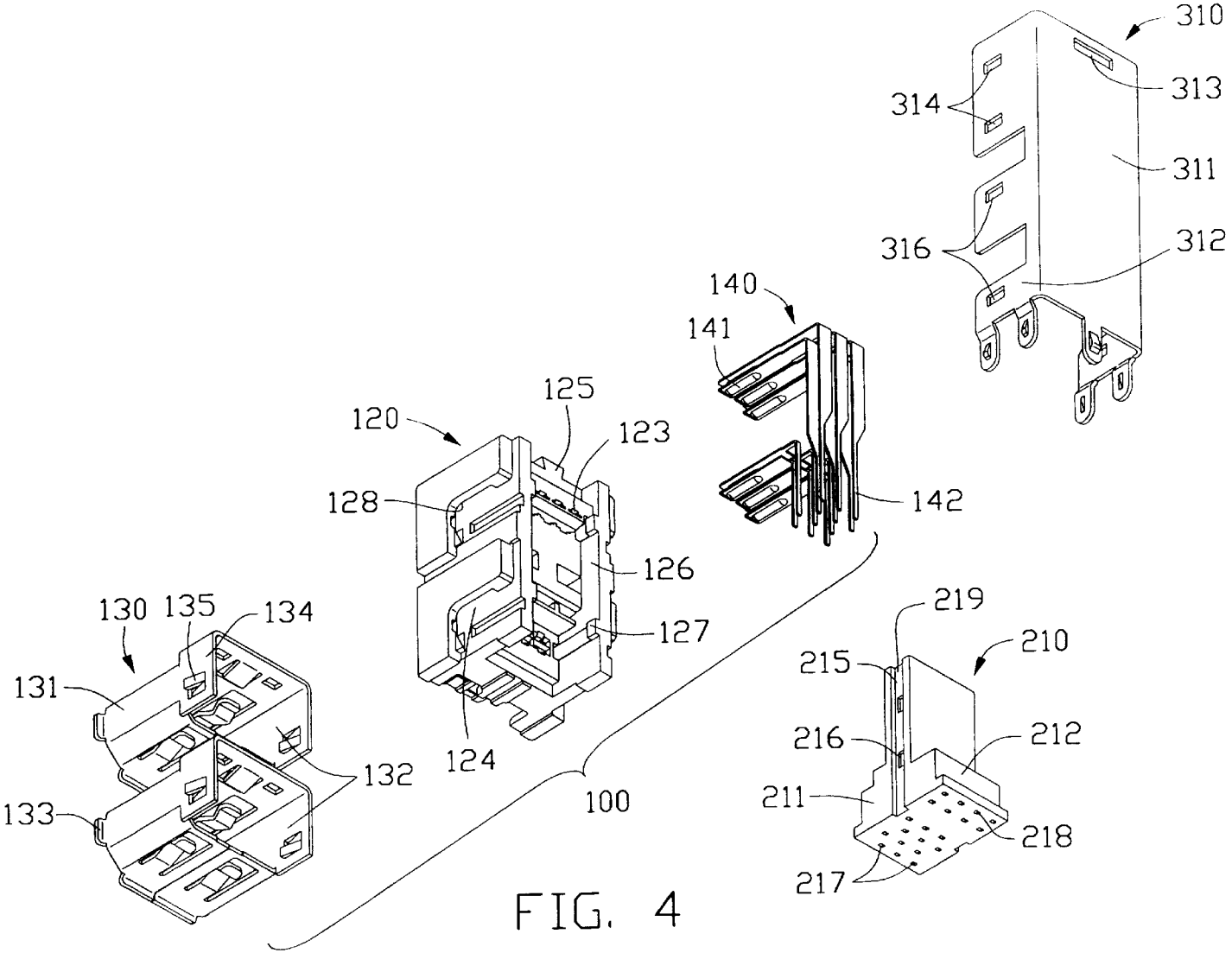
FIG. 4 is similar with FIG. 3 but taken from a different perspective.
Figure 5:
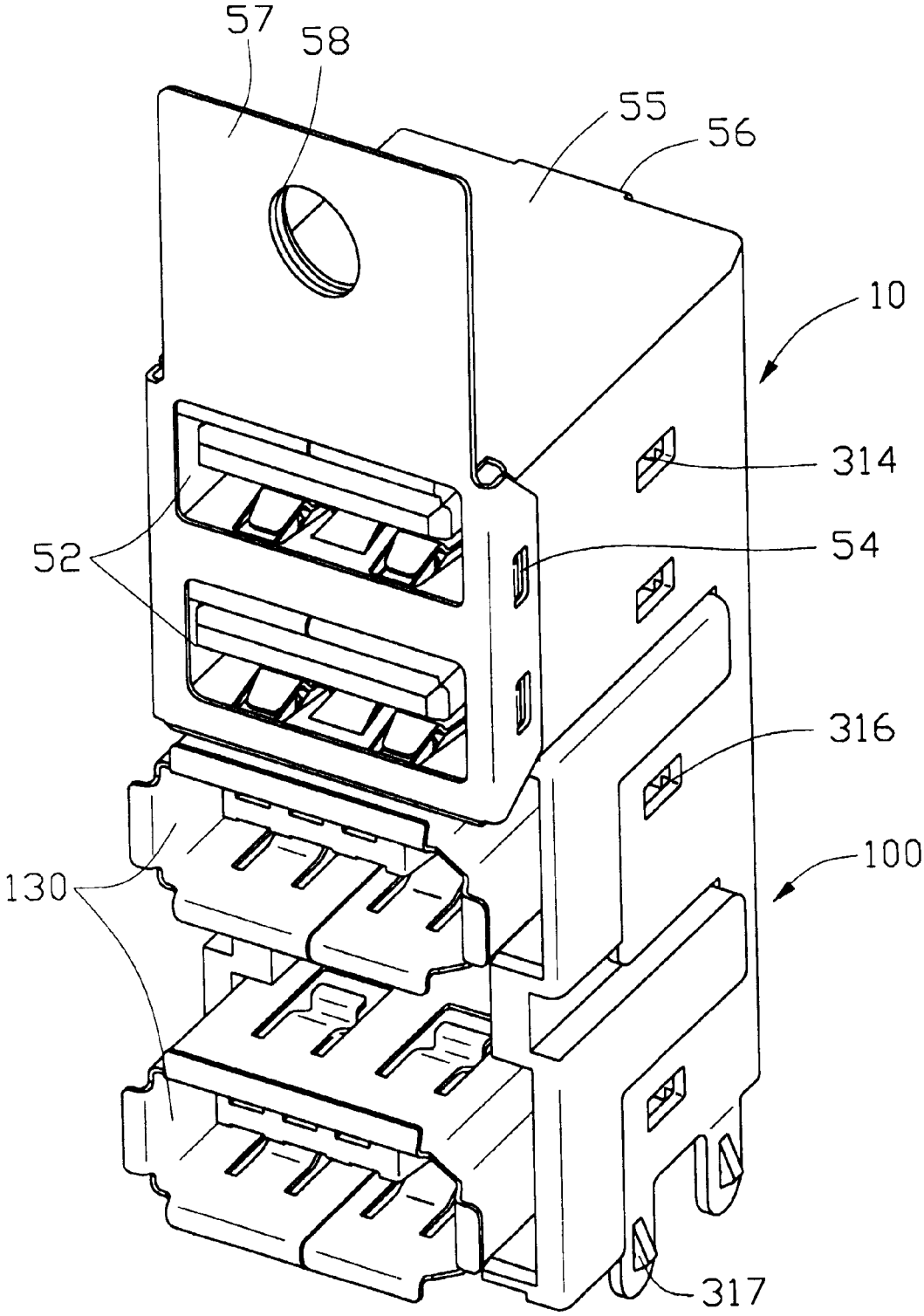
FIG. 5 is an assembled view of the electrical connector assembly in accordance with the present invention.

Referring to FIGS. 1 to 5, an electrical connector assembly in accordance with the present invention comprises an upper electrical connector 10, a lower electrical connector 100, an insulative spacer 210, and a rear shield 310.

The upper electrical connector 10 comprises an insulative housing 20, a pair of shielding shells 30, a plurality of electrical contacts 40, and a front shield 50. The insulative housing 20 comprises a pair of upper and lower chambers 21, 22 in communication with front and rear faces (unlabeled) of the housing 20, a pair of receiving plates 24 extending horizontally in the chambers 21, 22, respectively, and a groove 23 defined in an outer bottom surface of the housing 20. Each receiving plate 24 defines a plurality of passageways 240 in an upper portion thereof. A plurality of passages 26, 27 are formed in the rear face of the insulative housing 20. Opposite lateral sides of the insulative housing 20 are each in a step configuration and two passages 25 are defined in each lateral side. Each shielding shell 30 is in shape of a frame and is open in front and rear sides thereby defining a cavity 31 therethrough. A plurality of front tongues 32 are formed at front ends of top, the bottom, and opposite side walls of each shielding shell 30 to extend outward and rearward from the shell 30, and a pair of rear tongues 34 extending outwards from rear ends 33 of the opposite side walls of each shielding shell 30. A pair of spring plates 35 is formed adjacent to the rear ends 33 of the side walls of the shielding shell 30. The electrical contacts 40 of the upper electrical connector 10 are arranged in an upper row 41 and a lower row 42 and each comprises a horizontal engaging portion 43 for electrically engaging with contacts of complementary connectors and a vertical soldering portion 44 for being soldered to a printed circuit board on which the connector assembly is mounted. The electrical contacts 40 in the upper row 41 are relatively longer than those in the lower row 42. The front shield 50 comprises a vertical portion 51, a transverse portion 55 extending perpendicularly and rearward from a top of the vertical portion 51, and a mounting plate 57 extending vertically upward from the top of the vertical portion 51. The vertical portion 51 defines a pair of upper and lower windows 52, a pair of side sections 53, and a bottom section 59. The side sections 53 each define a pair of holes 54 therein. The transverse portion 55 forms a latch 56 at a rear end thereof. The mounting plate 57 defines a mounting hole 58 near an upper end thereof.

The lower connector 100 comprises a dielectric housing 120, a pair of inner shields 130, and a plurality of electrical contacts 140. The dielectric housing 120 comprises a pair of upper and lower chambers 121 in communication with front and rear faces of the housing 120, a pair of accommodating plates 122 extending in the chambers 121, respectively, and a rib 125 on a top surface of the housing 120. The dielectric housing 120 has two opposite lateral sides each define upper and lower recessed sections 124 therein. Each recessed section 124 extends to the rear face of the housing 120. The accommodating plates 122 each define a plurality of passageways 123 in the upper and the lower surfaces thereof. The passageways 123 extend from the front face to the rear face of the housing 120. Two spaces 128 are defined in each lateral side of the housing 120, wherein each space 128 is in communication with an upper edge of a corresponding recessed section 124. A pair of protrusions 127 protrudes inwardly from an inner surface 126 of a rear end of each lateral side of the housing 120. Each inner shield 130 is in shape of a roughly square frame with opened front and rear sides, thereby defining a cavity 132 through each inner shield 130. Rear portions 134 of the inner shields 130 are substantially larger than front portions 131 and are open in bottom sides thereof. Each shielding shell 130 forms a plurality of tabs 133 at front ends of bottom, top and opposite side walls of the front portion 131 of the shielding shell 130, and a pair of barbs 135 in rear portion 134 of the opposite side walls of the shielding shell 130. The electrical contacts 140 of the lower electrical connector 100 are arranged in four rows and each comprise a horizontal engaging portion 141 for engaging with contacts of complementary connectors, and a vertical soldering portion 142 for being soldered to the printed circuit board on which the connector assembled is mounted. The spacer 210 comprises a stepped front side 211, a stepped rear side 212, and an intermediate portion 219 connecting the front side 211 and the rear side 212. The front side 211 forms four front steps 213 thereon and each front step 213 defines a row of front through holes 217 therethrough. The rear side 212 forms two rear steps 214 thereon and each rear step 214 defines a row of rear through holes 218 therethrough. The intermediate portion 219 defines a pair of slots 215 in opposite sides thereof and each slot 215 has a pair of recess 216 therein.

The rear shield 310 comprises a main portion 311, a pair of side portions 312 extending forwardly and perpendicularly from opposite side edges of the main portion 311, and a plurality of grounding tabs 317 projecting from bottoms of the main portion 311 and the side portions 312 of the rear shield 310. The main portion 311 defines an elongated hole 313 near an upper edge of a middle part of the main portion 311. Each side portion 312 comprises three plates spaced by two cutouts. Each upmost plate comprises a pair of latch holes 314 therein and the two lower plates define a pair of latch apertures 316 therein.

In assembly, the two rows 41, 42 of the electrical contacts 40 of the upper electrical connector 10 are inserted through respective chambers 21, 22 of the insulative housing 20, wherein the engaging portions 43 are received by the passageways 240 of the receiving plates 24, respectively. The soldering portions 44 of the contacts 40 in the upper row 41 depend from an upper rear portion of the insulative housing 20 and extend through the passages 26, and the soldering portions 44 of the contacts 40 in the lower row 42 depend from a lower rear portion of the housing 20 and extend through the passages 27. The shielding shells 30 are inserted through the passages 25 and enclose the chamber 21, 22 to shield the engaging portions 43 of the electrical contacts 40. The front shield 50 encloses the front face of the housing 20; the windows 52 registering the front openings of the shielding shells 30 for letting complementary connectors (not shown) into the cavities 31; and the bottom section 59 supporting the front edge of the bottom of the insulative housing 20. The transverse portion 55 covers the top of the insulative housing 20. The front tongues 32 at the opposite side walls of the shielding shells 30 engage with the holes 54 of the side sections 53 of the front shield 50. The electrical contacts 140 are inserted through the chambers 121 of the dielectric housing 120 and the engaging portions 141 are received by the passageways 123 in the upper and lower surfaces of the accommodating plates 122 while the soldering portions 142 depend vertically alone the rear face of the housing 120, respectively. The inner shields 130 are inserted through the space 128 of the housing 120 and enclose the upper and lower chambers of 121 the housing 120 to shield the engaging portions 141 of the electrical contacts 140. The rib 125 of the lower connector 100 engages with the groove 23 of the upper connector 10. The soldering portions 142, 44 of the contacts 140, 40 extend through the front and rear through holes 217, 218 in the front and the rear steps 213, 214 of the spacer 210 while the protrusions 127 of the dielectric housing 120 are received in the recesses 215 of the spacer 210. The latch 56 of the front shield 50 latches with the elongated holes 313 of the rear shield 310. The spring plates 35 of the shielding shells 30 mate with the latch holes 314 of the rear shield 310. The barbs 135 of the inner shields 130 are received in the latch apertures 316 of the rear shield 310 to provide a retention force therebetween.

In use, the soldering portions 44, 142 of the electrical contacts 40, 140 extending beyond a bottom of the spacer 210 are soldered to the printed circuit board (not shown) while the grounding tabs 317 are soldered to the printed circuit board too. The mounting hole 58 are inserted through by a screw (not shown) to mount the electrical connector assembly to a panel (not shown) of a computer receiving the electrical connector assembly and the printed circuit board.

The connector assembly is stacked from two different types of electrical connectors 10, 100, so it provides an economical assembly and saves the precious space of the printed circuit board. The shielding shells 30, the front shield 50, the inner shields 130 and the rear shield 310 provide a reliable shielding to the electrical connector assembly thereby ensuring a reliable signal transmission. The spacer 210 securely retains the relatively long contacts 40, 140, thereby protecting the fragile contacts 40, 140 from damaging. The mounting hole 58 provides an enhanced fixing effectiveness of the connector assembly by attaching the assembly to a computer enclosure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an upper electrical connector comprising:

an insulative housing comprising a pair of chambers and a pair of receiving plates extending in the chambers, respectively;

a pair of frame-shaped shielding shells inserted in the housing, each shielding shell forming a pair of spring plates adjacent to rear opposite sides thereof;

a plurality of electrical contacts arranged in two rows, each contact comprising an engaging portion received by a corresponding receiving plate of the housing and a soldering portion extending beyond the insulative housing and depending from a rear of the housing; and a front shield comprising a vertical portion, a transverse portion extending rearwardly from a top of the vertical portion to cover a top of the insulative housing, and a mounting plate extending upwardly from the top of the vertical portion, the vertical portion defining a pair of windows registering with the chambers of the insulative housing, the transverse portion forming a latch at a rear end thereof, the mounting plate defining a mounting hole therein;

a lower connector comprising:

a dielectric housing assembled to a bottom of the insulative housing of the upper electrical connector, the dielectric housing comprising a pair of chambers and a pair of accommodating plates extending in the chambers, respectively;

a pair of frame-shaped inner shields inserted in the dielectric housing, each inner shield defining a pair of barbs in rear opposite sides thereof; and a plurality of electrical contacts arranged in four rows and each comprising an engaging portion and a soldering portion, the engaging portions being accommodated by the accommodating plates of the dielectric housing and the soldering portions extending beyond the dielectric housing and depending from a rear of the housing;

a spacer assembled to the dielectric housing of the lower connector, the spacer comprising a front side, a rear side, and an intermediate portion therebetween, the front side comprising four rows of through holes for receiving the soldering portions of corresponding electrical contacts of the lower connector, the rear side comprising two rows of through holes for receiving the soldering portions of corresponding electrical contacts of the upper electrical connector; and a rear shield enclosing the spacer and rear portions of the upper and the lower electrical connectors, the rear shield defining an elongated hole and two pairs of latch holes in an upper section thereof for engaging with the latch of the front shield and the spring plates of the shielding shells of the upper electrical connector, respectively, and two pairs of latch apertures in a lower section thereof for engaging the barbs of the inner shields of the lower electrical connector;

wherein the shielding shells of the upper electrical connector each form a pair of front tongues on front opposite sides thereof and the vertical portion of the front shield of the upper electrical connector comprises a pair of side sections each defining a pair of holes therein corresponding to the front tongues of the shielding shells;

wherein the rear shield comprises a main portion and a pair of side portions, the main portion comprising the elongated hole and the side portions comprising the latch holes and the latch apertures in upper and lower sections thereof, respectively;

wherein the front side of the spacer is stepped-configured and comprises four steps forming the four rows of through holes, and the rear side of the spacer is stepped-configured and comprises two steps forming the two rows of through holes;

wherein the insulative housing of the upper electrical connector defines a groove in a bottom surface thereof and the dielectric housing of the lower electrical connector forms a rib on a top surface thereof to engage with the groove;

wherein the insulative housing of the upper electrical connector further forms two pairs of protrusions protruding inwardly from opposite inner surfaces of a rear end thereof, and the intermediate portion of the spacer defines a pair of slots in opposite sides thereof, each slot forming a pair of recesses therein for engaging with the protrusions.

* * * * *